US010119218B2

(12) United States Patent
Han et al.

(10) Patent No.: US 10,119,218 B2
(45) Date of Patent: Nov. 6, 2018

(54) WASHING MACHINE

(71) Applicant: SAMSUNG ELECTRONICS CO., LTD., Suwon-si, Gyeonggi-do (KR)

(72) Inventors: Won Jae Han, Suwon-si (KR); Do Haeng Kim, Suwon-si (KR); Young-Hyun Kim, Suwon-si (KR); Ji Yoon Kim, Seongnam-si (KR); Min Hwan Oh, Suwon-si (KR); Hong Seok Ko, Yongin-si (KR); Jae Hee Jo, Suwon-si (KR); Je Wan Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 177 days.

(21) Appl. No.: 14/874,882

(22) Filed: Oct. 5, 2015

(65) Prior Publication Data

US 2016/0230326 A1 Aug. 11, 2016

Related U.S. Application Data

(60) Provisional application No. 62/112,887, filed on Feb. 6, 2015.

(30) Foreign Application Priority Data

Mar. 19, 2015 (KR) ..... 10-2015-0038164

(51) Int. Cl.
*D06F 39/14* (2006.01)
*D06F 39/12* (2006.01)
(Continued)

(52) U.S. Cl.
CPC ..... *D06F 39/14* (2013.01); *D06F 29/00* (2013.01); *D06F 31/00* (2013.01); *D06F 39/12* (2013.01); *D06F 1/04* (2013.01); *D06F 23/04* (2013.01)

(58) Field of Classification Search
CPC ..... D06F 29/00; D06F 31/00; D06F 39/12; D06F 39/14
See application file for complete search history.

(56) References Cited

U.S. PATENT DOCUMENTS 3,026,699 A * 3/1962 Rhodes ..... D06F 29/00 68/12.19
3,039,284 A * 6/1962 Shelton ..... D06F 29/00 137/360

(Continued)

FOREIGN PATENT DOCUMENTS

JP 588484 * 1/1983
KR 2020130001857 * 3/2013 ..... D06F 3/02
KR 10-2013-0041099 4/2013

OTHER PUBLICATIONS

Machine translation of KR 20-2013-0001857, no date.*

*Primary Examiner* — Joseph L. Perrin
(74) *Attorney, Agent, or Firm* — Staas & Halsey LLP

(57) ABSTRACT

A washing machine includes a door and an auxiliary washing unit that may be readily fastened to each other by a locking unit for fastening the door and the auxiliary washing unit. The washing machine includes a main body in which an opening is formed, a door that opens and closes the opening, an auxiliary washing unit that is provided on an inner side of the door to form an auxiliary washing space, and a locking unit that locks the door and the auxiliary washing unit. Here, the locking unit may perform linear motion in one direction to lock or unlock the door and the auxiliary washing unit.

10 Claims, 12 Drawing Sheets

(51) Int. Cl.

| | |
|---|---|
| ***D06F 29/00*** | (2006.01) |
| ***D06F 31/00*** | (2006.01) |
| *D06F 1/04* | (2006.01) |
| *D06F 23/04* | (2006.01) |

(56) References Cited

U.S. PATENT DOCUMENTS

| | | | | | |
|---|---|---|---|---|---|
| 3,039,286 | A * | 6/1962 | Shelton | D06F 29/00 | 137/312 |
| 3,209,560 | A * | 10/1965 | Shelton | D06F 13/00 | 68/14 |
| 3,575,020 | A * | 4/1971 | Hubbard | G06F 13/00 | 68/12.19 |
| 5,253,493 | A * | 10/1993 | Ohashi | D06F 29/00 | 220/812 |
| 7,296,443 | B2 * | 11/2007 | Usherovich | D06F 39/14 | 312/228.1 |
| 2002/0134117 | A1 * | 9/2002 | Arai | D06F 19/00 | 68/3 SS |
| 2005/0072194 | A1 * | 4/2005 | Ryohke | D06F 19/00 | 68/3 R |

* cited by examiner

WASHING MACHINE

CROSS-REFERENCE TO RELATED APPLICATIONS

This application claims the priority benefit of Korean Patent Application No. 10-2015-0038164, filed on Mar. 19, 2015 in the Korean Intellectual Property Office and U.S. Provisional Patent Application No. 62/112,887, filed on Feb. 6, 2015 in the United States Patent and Trademark Office, the disclosures of each of which are incorporated herein by reference in their entirety.

BACKGROUND

1. Field

Embodiments of the disclosure relate to a washing machine that may include a door assembly having an improved structure.

2. Description of the Related Art

A washing machine generally refers to a machine that washes clothes using power. The washing machine may include a fixing tub that stores washing water, a rotating tub that is rotatably provided inside the fixing tub, and a pulsator that is rotatably provided on the bottom of the rotating tub. In general, the washing machine forms a washing space by the fixing tub and the rotating tub.

The washing machine may be classified into an agitator type washing machine, a pulsator type washing machine, and a drum type washing machine. The agitator type washing machine washes laundry by rotating a washing rod formed at the center of a washing tub in the left and right direction. The pulsator type washing machine washes laundry using a frictional force between the laundry and a water flow generated by rotating a disc-shaped pulsator formed in a lower portion of the rotating tub in the left and right direction. The drum type washing machine washes laundry by putting water, detergent, and laundry into a drum with a plurality of lifters that protrude from an inner surface thereof and rotating the drum.

The washing machine may be classified into a top loading washing machine and a front loading washing machine according to its type. The top loading washing machine refers to a washing machine in which laundry can be loaded into the rotating tub through an opening provided on a top surface of the washing machine. The front loading washing machine refers to a washing machine in which laundry can be loaded into the rotating tub through an opening provided on a side surface of the washing machine. In general, the agitator type washing machine and the pulsator type washing machine are provided in the form of the top loading washing machine, and the drum type washing machine is provided in the form of the front loading washing machine.

SUMMARY

Therefore, it is an aspect of the disclosure to provide a washing machine of which a locking unit may be slidably provided in forward and rearward directions so that a door and an auxiliary washing unit may be readily locked to each other.

Additional aspects of the disclosure will be set forth in part in the description which follows and, in part, will be apparent from the description, or may be learned by practice of the disclosure.

In accordance with an aspect of the disclosure, a washing machine may include: a main body in which an opening is formed, a door that opens and closes the opening, an auxiliary washing unit that is provided on an inner side of the door to form an auxiliary washing space, and a locking unit that locks the door and the auxiliary washing unit. Here, the locking unit may perform linear motion in one direction to lock or unlock the door and the auxiliary washing unit.

The locking unit may be provided to perform linear motion in forward and rearward directions.

The locking unit may be provided to be rotatable about a rotation protrusion that protrudes from the body.

The rotation protrusion may be rotatably mounted to the door.

In the door, an accommodating portion in which the rotation protrusion is rotatably inserted may be provided.

The accommodating portion may be a space in which a diameter in one direction is formed longer than a diameter in the other direction.

The accommodating portion may be formed in an ellipse which is formed long (to be elongated) in forward and rearward directions.

The rotation protrusion may perform linear and rotational motion inside the accommodating portion.

When an external force is applied to the locking unit, the locking unit may be moved forward.

The locking unit may include an elastic member that provides an elastic force to the locking unit, and when the external force applied to the locking unit is removed, the locking unit may be moved rearward by the elastic member and returned to a position before the external force is applied.

The locking unit may be mounted to the door to perform linear and rotational motion.

In the auxiliary washing unit, an interference portion that protrudes forward and is interfered with by the locking unit may be provided.

When the locking unit is linearly moved forward, interference of the locking unit may be released by the interference portion.

When the locking unit locks the door and the auxiliary washing unit, the door and the auxiliary washing unit may be integrally rotatable.

The door and the auxiliary washing unit may be rotatable about the same rotational axis.

In accordance with an aspect of the disclosure, a washing machine may include: a main body in which an opening is formed on one side thereof and which may include a main washing space, a door that is rotatably provided on the opening, an auxiliary washing unit that forms an auxiliary washing space that is separated from the main washing space so that auxiliary washing is independently achieved, and a locking unit that is rotatably mounted to lock or unlock the door and the auxiliary washing unit. A rotational axis of the locking unit may be provided to be linearly moved forward by an external force.

When the rotational axis of the locking unit is moved forward, an interference state between the rotational axis and the auxiliary washing unit may be released, so that the door and the auxiliary washing unit are unlocked from each other.

When the external force applied to the locking unit is removed, the rotational axis of the locking unit may be moved rearward and returned to a position before the external force is applied.

The locking unit may include an elastic member, and the rotational axis of the locking unit may be returned to the position before the external force is applied, by an elastic force of the elastic member.

The elastic member may be interposed between the door and the locking unit.

In the door, an accommodating portion in which the rotational axis of the locking unit is accommodated may be formed, and a diameter of the accommodating portion in forward and rearward directions may be larger than a diameter thereof in a vertical direction.

In the auxiliary washing unit, an interference portion that protrudes forward and is selectively interfered with by the locking unit may be provided.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
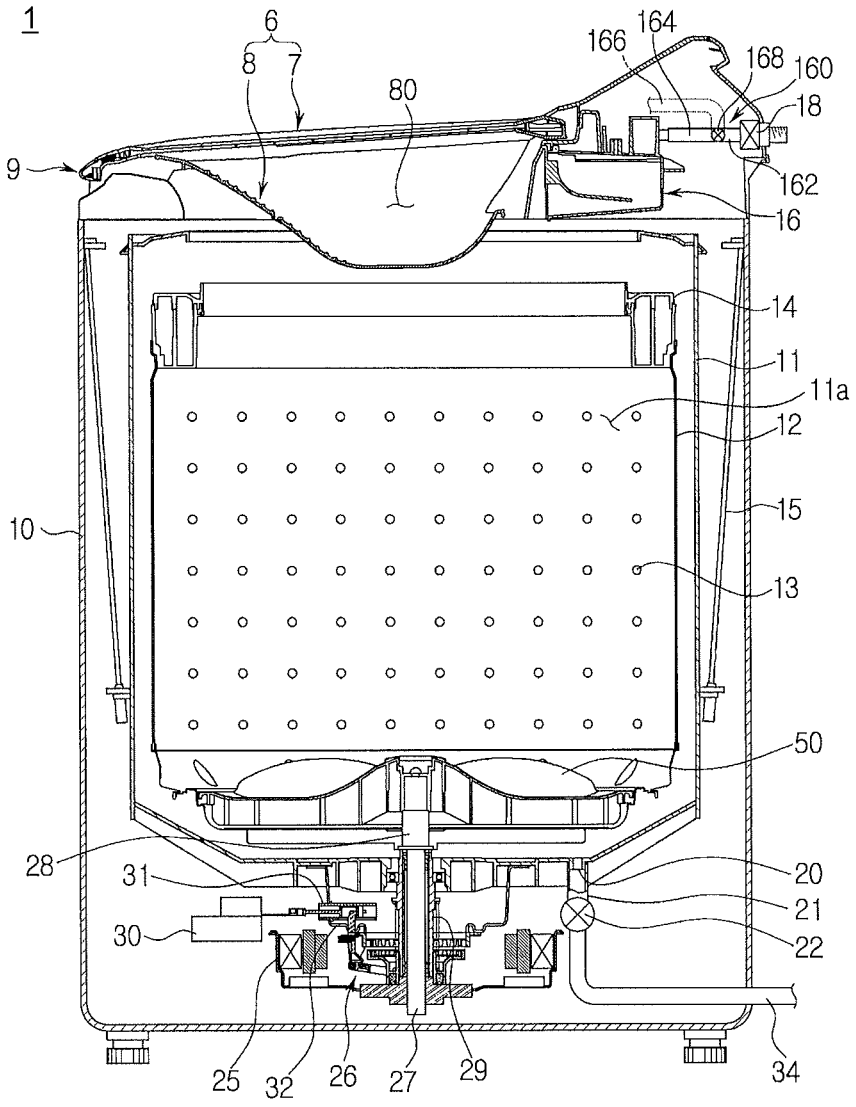
FIG. 1 is a cross-sectional view showing a washing machine in accordance with an embodiment of the disclosure.

Reference will now be made in detail to embodiments of the disclosure, examples of which are illustrated in the accompanying drawings, wherein like reference numerals refer to like elements throughout.

Hereinafter, a washing machine in accordance with an embodiment of the disclosure will be described in detail with the accompanying drawings.

FIG. 1 is a cross-sectional view showing a washing machine in accordance with an embodiment of the disclosure.

As shown in FIG. 1, a washing machine 1 may include a cabinet 10 that forms an appearance, a fixing tub 11 that is disposed inside the cabinet 10 to store washing water, a rotating tub 12 that is rotatably disposed inside the fixing tub 11, and a pulsator 50 that is disposed inside the rotating tub 12 to generate a water flow.

In an upper portion of the cabinet 10, an opening 24 through which laundry can be put into the rotating tub 12 is formed. The opening 24 may be opened and closed by a door assembly 6 provided in the upper portion of the cabinet 10. The fixing tub 11 may be supported by a suspension device 15 within the cabinet 10.

The door assembly 6 may include a door 7 and an auxiliary washing unit 8. The door assembly 6 may include a locking unit 9 that locks the door 7 and the auxiliary washing unit 8 so that the door 7 and the auxiliary washing unit 8 may be integrally operated. A detailed description of the door assembly 6 will be described later.

In an upper portion of the fixing tub 11, a water supply device 160 for water supply to a main washing space 11*a* and an auxiliary washing space 80, which will be described later, may be provided. The water supply device 160 may include a water supply pipe 162, a main water supply pipe 164 for supplying water into the main washing space 11*a*, an auxiliary water supply pipe 166 for supplying water into the auxiliary washing space 80, and a switching unit 168.

One end of the water supply pipe 162 may be connected to a water supply valve 18, and the other end thereof may be connected to the switching unit 168. The water supply pipe 162 may be provided so as to transmit washing water supplied from the water supply valve 18 to the switching unit 168.

The switching unit 168 may be provided so as to selectively supply the washing water transmitted from the water supply pipe 162, to any one of the main water supply pipe 164 and the auxiliary water supply pipe 166. Through the control of the switching unit 168, the washing water may be supplied to the washing space through at least one of the main water supply pipe 164 and the auxiliary water supply pipe 166. The main water supply pipe 164 may be connected to a detergent supply device 16 so that the washing water supplied through the main water supply pipe 164 may be supplied to the main washing space 11*a* through the detergent supply device 16. The switching unit 168 may be a three-way valve.

The rotating tub 12 may be shaped in the shape of a cylinder of which an upper portion is opened, and a plurality of dehydration holes 13 may be formed on a side surface of the rotating tub 12. A balancer 14 may be mounted in an upper portion of the rotating tub 12, so that the rotating tub 12 may be stably rotated at the time of high-speed rotation.

On the lower outside of the fixing tub 11, a motor 25 that generates a driving force for rotating the rotating tub 12 and the pulsator 50 and a power switching device 26 that simultaneously or selectively transmits the driving force generated from the motor 25 to the rotating tub 12 and the pulsator 50 may be provided.

A hollow dehydration shaft 29 may be coupled to the rotating tub 12, and a washing shaft 27 provided in a hollow portion of the dehydration shaft 29 may be coupled to the pulsator 50 through a washing shaft coupling portion 28. The motor 25 may simultaneously or selectively transmit the driving force to the rotating tub 12 and the pulsator 50 in response to the elevating operation of the power switching device 26.

The power switching device 26 may include an actuator 30 that generates a driving force for power switching, a rod portion 31 that is linearly moved in accordance with the operation of the actuator 30, and a clutch portion 32 that is connected to the rod portion 31 and rotated in accordance with the operation of the rod portion 31.

On a bottom of the fixing tub 11, a drainage port 20 for discharging washing water stored in the fixing tub 11 may be formed, and a first drainage pipe 21 may be connected to the drainage port 20. In the first drainage pipe 21, a drainage valve 22 for regulating draining of the washing water may be provided. An outlet of the drainage valve 22 may be connected to a second drainage pipe 34 for discharging washing water to the outside.

Figure 2:
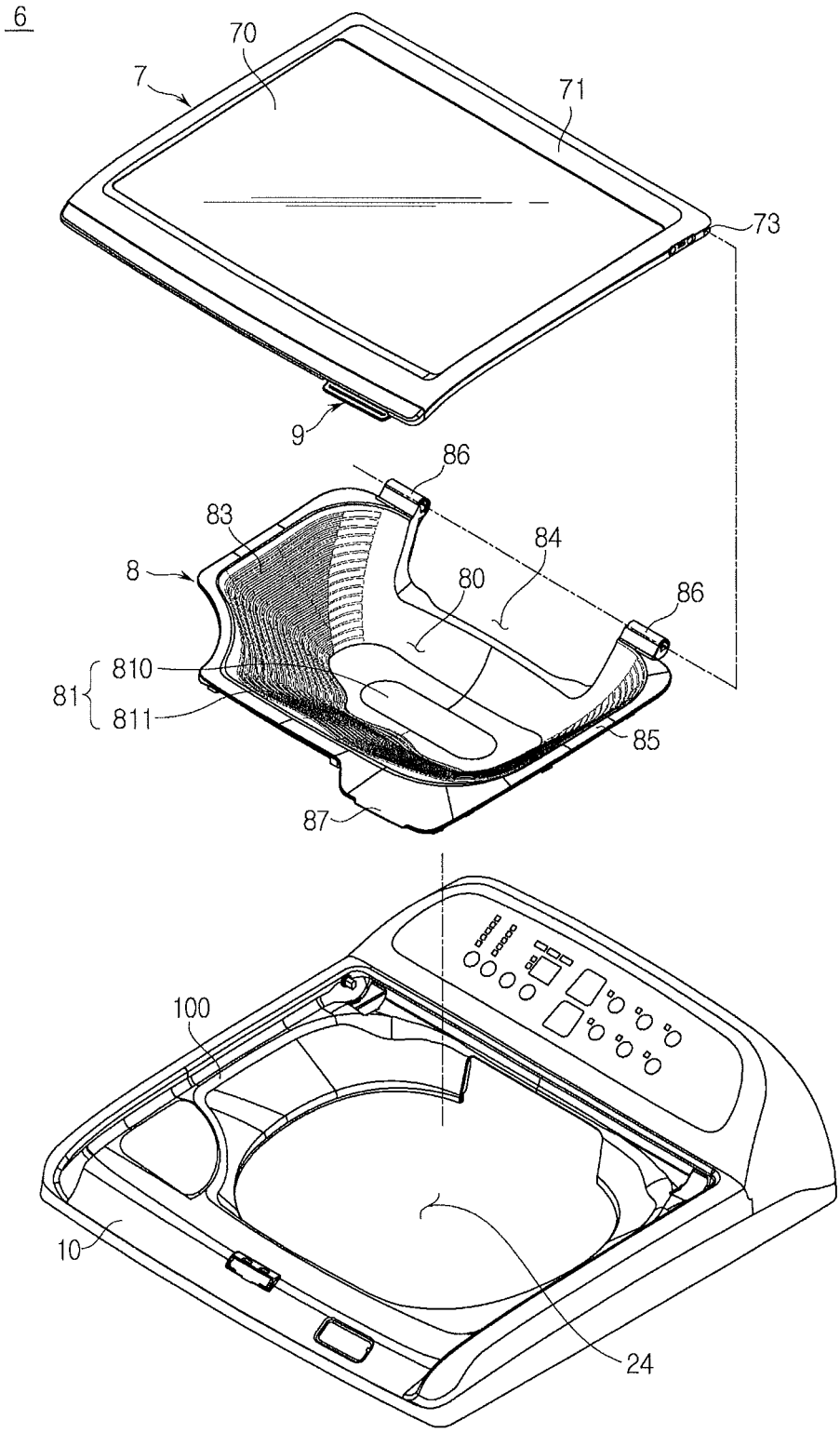
FIG. 2 is an exploded perspective view showing a door assembly and a main body cover of a washing machine in accordance with an embodiment of the disclosure.
Figure 3:
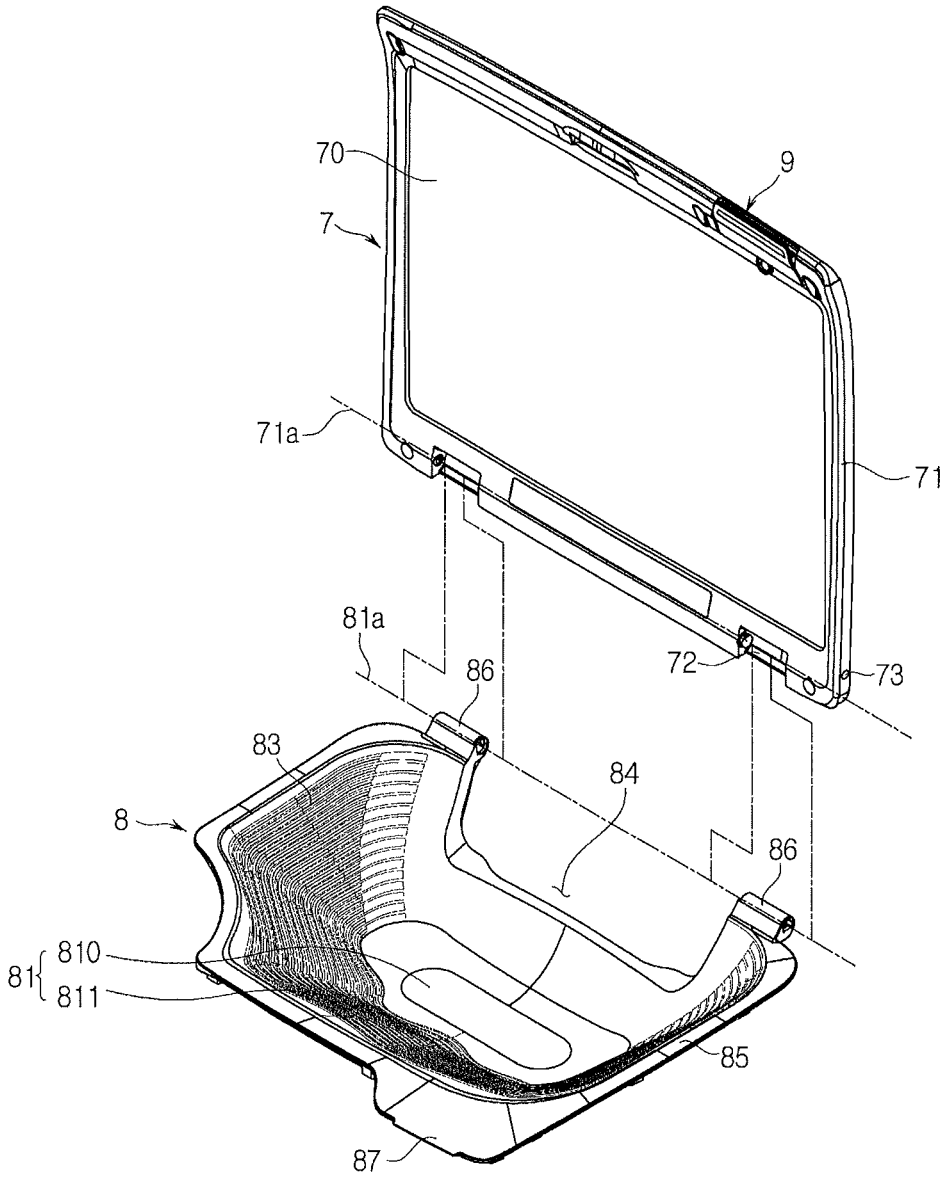
FIG. 3 is a perspective view showing a coupling structure of a door assembly in accordance with an embodiment of the disclosure.

FIG. 2 is an exploded perspective view showing a door assembly and a main body cover of a washing machine in accordance with an embodiment of the disclosure, and FIG. 3 is a perspective view showing a coupling structure of a door assembly in accordance with an embodiment of the disclosure.

Referring to FIGS. 2 and 3, the door assembly 6 in accordance with an embodiment of the disclosure may be provided to open and close the opening 24. The door assembly 6 may include the door 7 and the auxiliary washing unit 8.

A transparent member 70 may be provided in the door 7 so that the inside may be viewed from the outside even when the opening 24 is closed by the door 7. The transparent member 70 may be provided on an inner side of a door frame 71. On a front side of the door frame 71, a door handle portion that may be adjusted by a user may be further provided.

The auxiliary washing unit 8 may include the auxiliary washing space 80 so that laundry may be separately washed by hand. The auxiliary washing space 80 may be provided separately from the main washing space 11*a* formed by the fixing tub 11 and the rotating tub 12 so that washing may be performed in the auxiliary washing space 80.

The main washing space 11*a* and the auxiliary washing space 80 may be spatially separated from each other, so that washing may be independently performed in each of the main washing space 11*a* and the auxiliary washing space 80. In addition, washing in the main washing space 11*a* and washing in the auxiliary washing space 80 may be separately or simultaneously performed.

The door 7 and the auxiliary washing unit 8 may be provided to be rotatable about rotational axes 71*a* and 81*a* respectively provided on one sides of the door 7 and the auxiliary washing unit 8. The auxiliary washing unit 8 may be provided to be rotatable about the rotational axis provided on an inner one side of the door 7. The auxiliary rotational axis 81*a* of the auxiliary washing unit 8 and the door rotational axis 71*a* of the door 7 may be positioned on the same straight line (coaxially).

The auxiliary washing unit 8 may include a unit body 81 constituted of a bottom portion 810 and a side surface portion 811. The auxiliary washing space 80 of the auxiliary washing unit 8 may be formed by the unit body 81. The bottom portion 810 may be a portion that determines a depth of the auxiliary washing space 80, and may be provided to have a flat or curved surface. The side surface portion 811 may be formed to be inclined toward the bottom portion 810. The bottom portion 810 and the side surface portion 811 may be provided to form the roughly or substantially concave-shaped auxiliary washing space 80, so that washing water may be supplied into the auxiliary washing space 80 to perform auxiliary washing.

Meanwhile, a frictional protrusion 83 may be formed in the unit body 81. The frictional protrusion 83 may be provided on the bottom portion 810 or side surface portion 811 of the unit body 81 so that auxiliary washing may be readily performed. The frictional protrusions 83 may be formed to protrude convexly from inner surfaces of the unit body 81 which are respectively adjacent to the frictional protrusions 83. By the frictional protrusions 83, a frictional force between the frictional protrusions 83 and laundry is increased when auxiliary washing is performed, so that dirt of the laundry may be easily removed.

The auxiliary washing unit 8 may include an auxiliary drainage port 84. Through the auxiliary drainage port 84, washing water used in the auxiliary washing space 80 may be drained. The auxiliary drainage port 84 may be formed by opening a part of the unit body 81. The auxiliary drainage port 84 may be provided on the side surface portion 811. When the auxiliary washing unit 8 is rotated about the auxiliary rotational axis 81*a*, the washing water stored in the auxiliary washing space 80 may be discharged through the auxiliary drainage port 84.

The auxiliary washing unit 8 may include a seating flange 85. The seating flange 85 may extend laterally along a periphery of an upper end of the unit body 81 so that the seating flange 85 may be seated on an upper end of the cabinet 10.

On an inner surface of the opening 24 of the cabinet 10, a seating portion 100 that protrudes along a periphery of the opening 24 may be provided. The seating flange 85 may be seated on the seating portion 100. The seating flange 85 may be seated on the seating portion 100, so that the auxiliary washing unit 8 may be fixed to the cabinet 10.

The door 7 may be provided to be rotatable about the door rotational axis 71*a*, and the auxiliary washing unit 8 may be provided to be rotatable about the auxiliary rotational axis 81*a*. The door 7 and the auxiliary washing unit 8 may be provided to be rotatable independently from each other. The door rotational axis 71*a* and the auxiliary rotational axis 81*a* may be disposed on the same side surface with respect to the door 7 and the auxiliary washing unit 8, and thereby be opened and closed in the same direction. The door rotational axis 71*a* and the auxiliary rotational axis 81*a* may be positioned on the same straight line.

On one side of the auxiliary washing unit 8, an auxiliary rotating portion 86 may be provided. In the door 7, a first accommodating portion 72 in which the auxiliary rotating portion 86 is accommodated may be provided. The auxiliary rotating portion 86 may be accommodated in the first accommodating portion 72 to be rotatably coupled to the door 7.

On a side surface of the door 7, a second accommodating portion 73 may be provided. A door rotating portion (not shown) that protrudes in a direction of the door rotational axis 71*a* may be provided in the cabinet 10 so that the door 7 may be rotated about the door rotational axis 71*a*. The door rotating portion (not shown) may be accommodated in the second accommodating portion 73, and therefore the door 7 may be rotatably supported with respect to the cabinet 10.

A structure in which the door 7 is rotatably supported with respect to the cabinet 10, a structure in which the auxiliary washing unit 8 is rotatably supported with respect to the door 7, and the like are not limited to the above-description, and any structure is possible as long as the door 7 and the auxiliary washing unit 8 are provided to be rotatable independently from each other.

Figure 4:
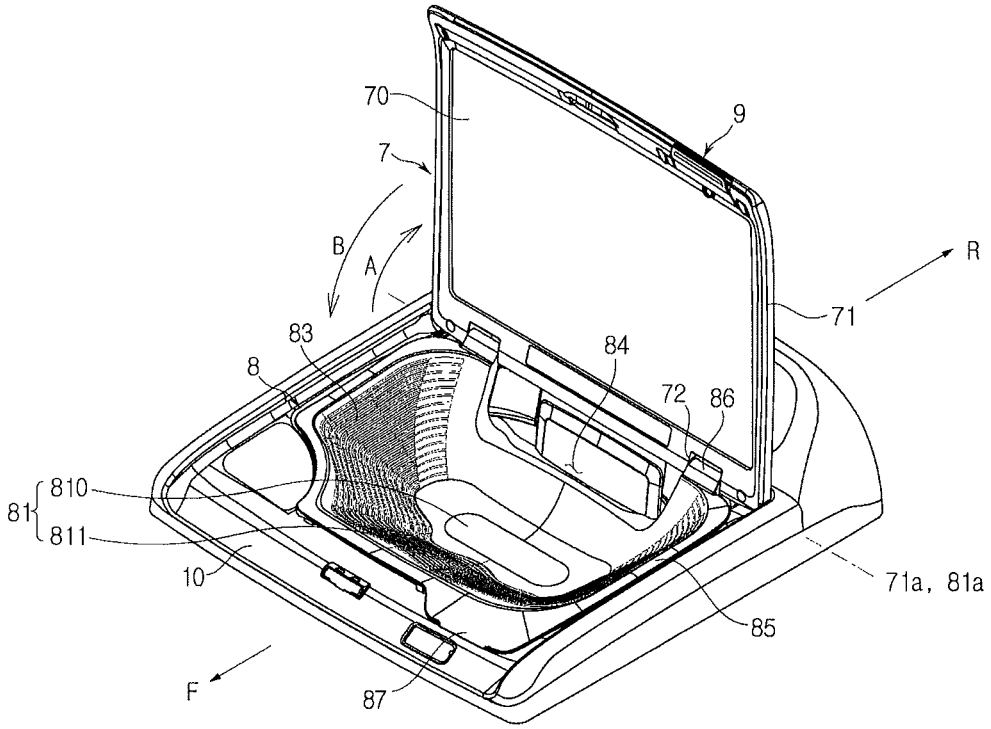
FIGS. 4 and 5 are views showing an operating state of a door assembly of a washing machine in accordance with an embodiment of the disclosure.
Figure 5:
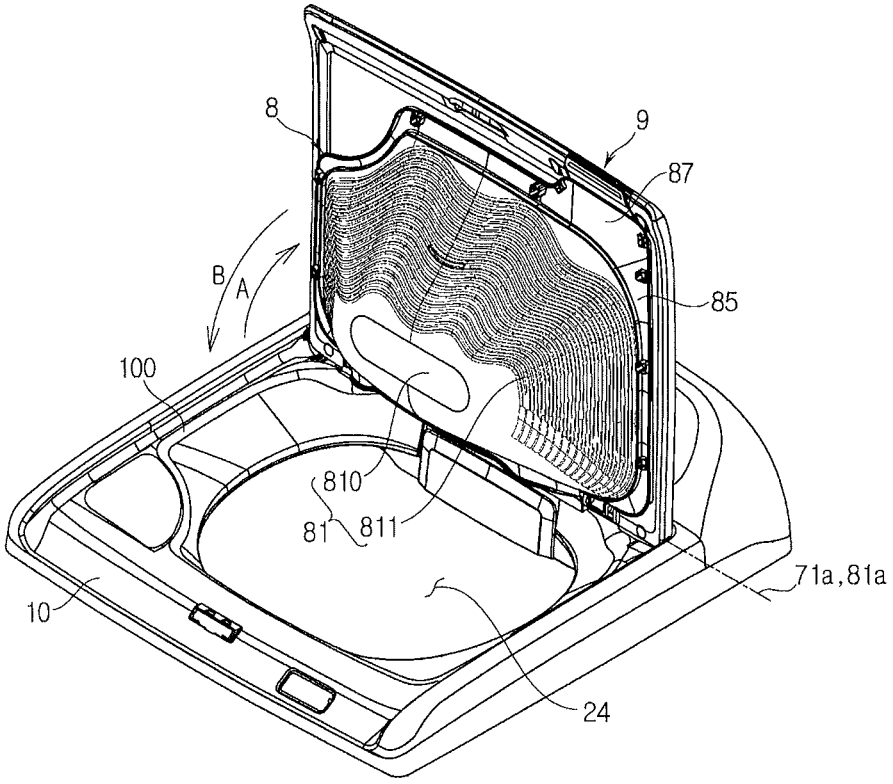

FIGS. 4 and 5 are views showing an operating state of a door assembly of a washing machine in accordance with an embodiment of the disclosure.

Referring to FIGS. 4 and 5, the door 7 and the auxiliary washing unit 8 may be locked to each other by the locking unit 9. When the door 7 and the auxiliary washing unit 8 are locked to each other, the door 7 and the auxiliary washing unit 8 may be integrally rotated about the rotational axes 71*a* and 81*a*. When the door 7 and the auxiliary washing unit 8 are unlocked from each other, the door 7 and the auxiliary washing unit 8 may be separated from each other to be rotatable (separately) about the rotational axes 71*a* and 81*a* respectively.

For example, when a user wishes to perform auxiliary washing in a state in which the opening 24 is closed by the door assembly 6, the user may release a locking state of the locking unit 9 and rotate the door 7 about the door rotational axis 71*a* in one direction A to open the door 7, as shown in FIG. 4. In a state in which the door 7 is opened, the user may perform auxiliary washing in the auxiliary washing space 80.

When a user wishes to put laundry into the main washing space 11*a* in a state in which the opening 24 is closed by the door assembly 6, the user may open the door 7 and the auxiliary washing unit 8 by simultaneously rotating the door 7 and the auxiliary washing unit 8 about the rotational axes 71*a* and 81*a* in the one direction A in a state in which the door 7 and the auxiliary washing unit 8 are locked to each other by the locking unit 9, as shown in FIG. 5.

In a state in which the locking states of the door 7 and the auxiliary washing unit 8 are released (unlocked), the door 7 and the auxiliary washing unit 8 may be respectively rotated about the rotational axes 71*a* and 81*a* separately from each other.

In order to enable the opening 24 to be closed by the door assembly 6, a user may rotate the door 7 and the auxiliary washing unit 8 about the rotational axes 71*a* and 81*a* in another direction B. In a position in which the opening 24 is closed by the door assembly 6, the user may press a top surface of the door 7 so that the door 7 and the auxiliary washing unit 8 may be locked to each other.

Hereinafter, a structure in which the door 7 and the auxiliary washing unit 8 are locked to each other or unlocked from each other by the locking unit 9 will be described.

Figure 6:
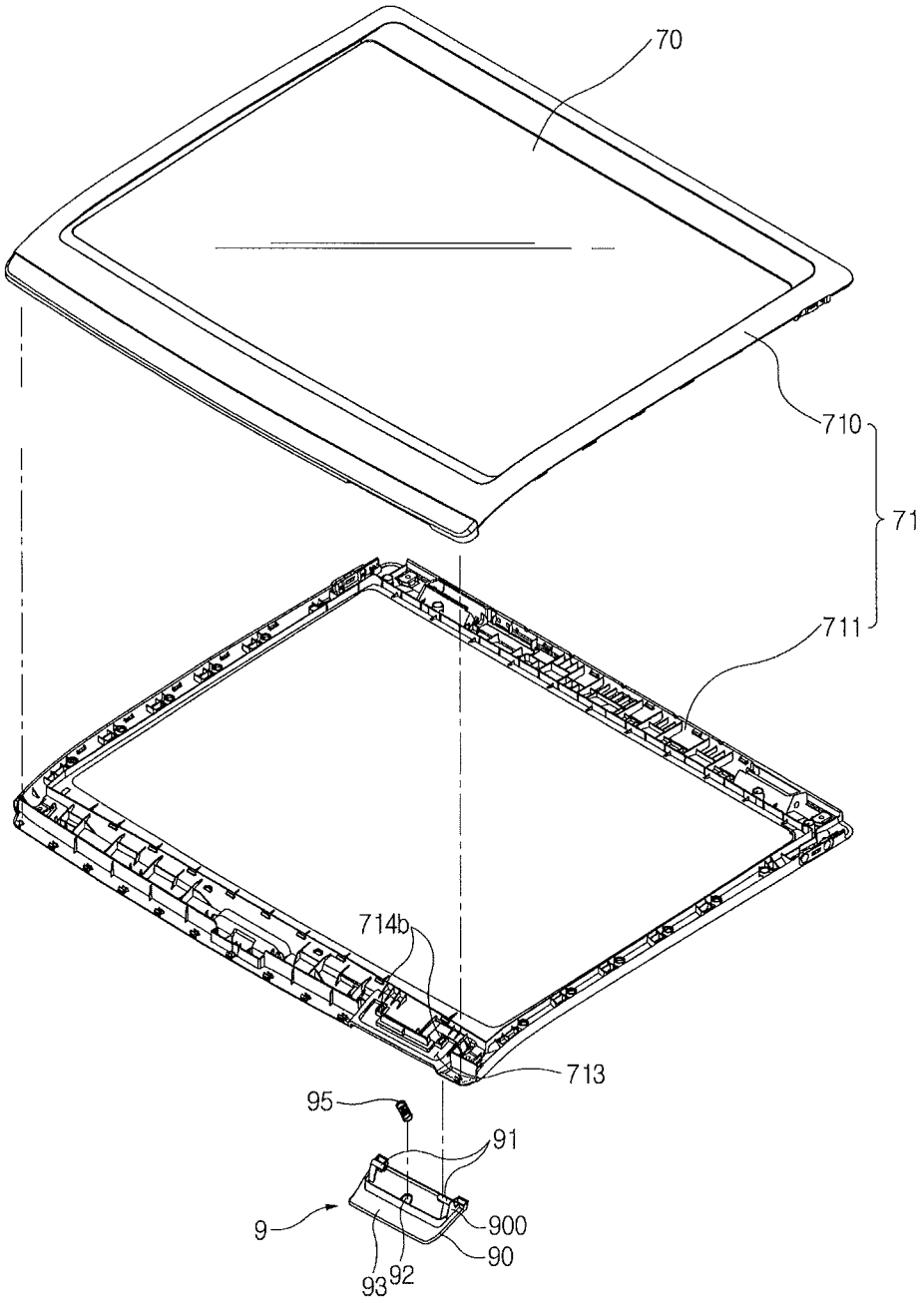
FIG. 6 is an exploded perspective view showing a door assembly in accordance with an embodiment of the disclosure.
Figure 7:
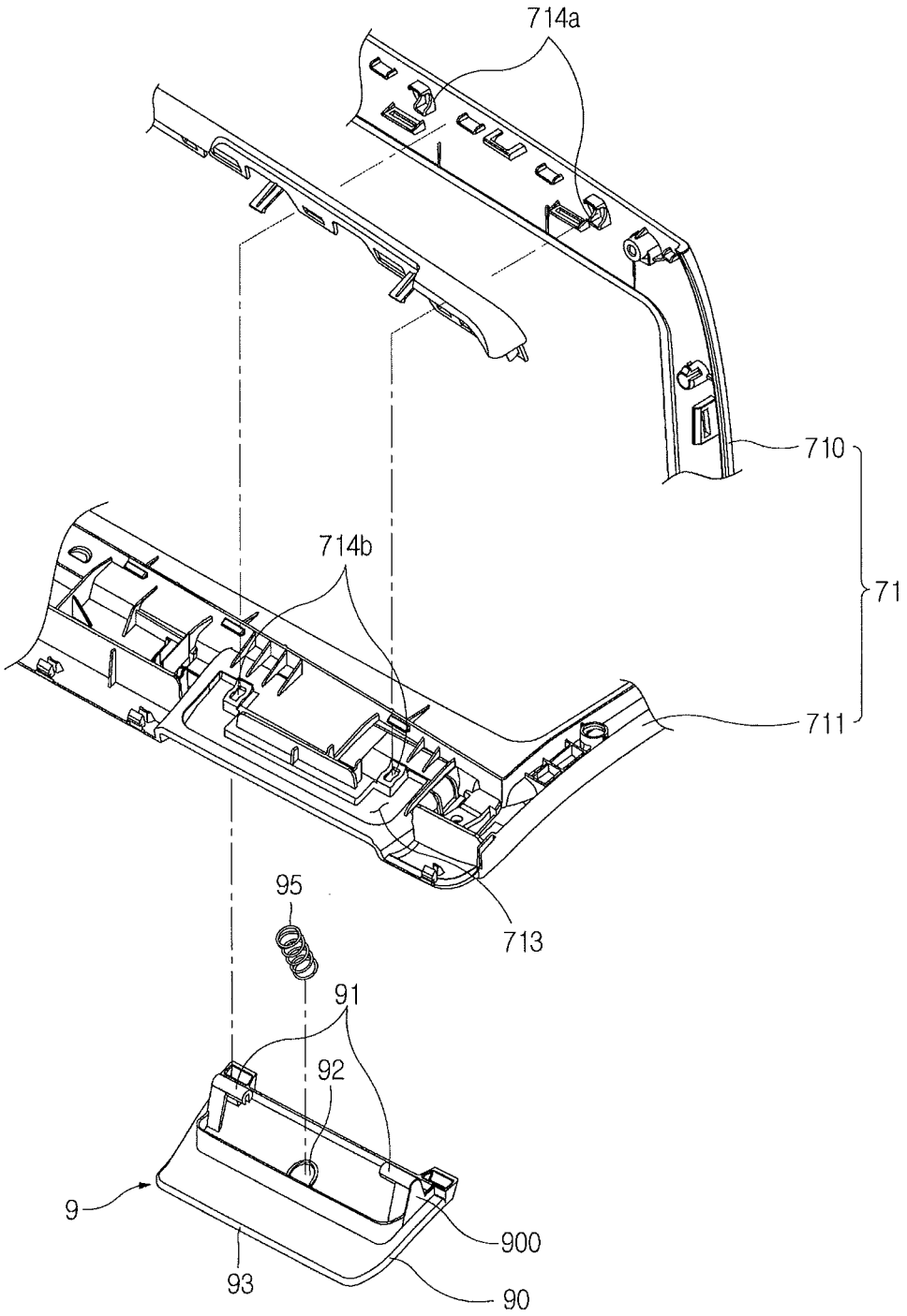
FIG. 7 is an exploded perspective view showing a locking unit of a door assembly in accordance with an embodiment of the disclosure.

FIG. 6 is an exploded perspective view showing a door assembly in accordance with an embodiment of the disclosure, and FIG. 7 is an exploded perspective view showing a locking unit of a door assembly in accordance with an embodiment of the disclosure.

Referring to FIGS. 6 and 7, the door 7 and the auxiliary washing unit 8 of the door assembly 6 in accordance with an embodiment of the disclosure may be locked to each other by the locking unit 9. The door 7 and the auxiliary washing unit 8 may be locked to each other by the locking unit 9 to be integrally rotated, and when the locking state between the door 7 and the auxiliary washing unit 8 is released, the door 7 and the auxiliary washing unit 8 may be rotated separately from each other.

The locking unit 9 may be provided in the door 7, and an interference portion 87 that may be interfered with by the locking unit 9 may be provided in the auxiliary washing unit 8. When the interference portion 87 is interfered with by the locking unit 9, the door 7 and the auxiliary washing unit 8 may be locked to each other to be integrally operated. The interference portion 87 may extend forward from the side surface portion 811 of the auxiliary washing unit 8.

The locking unit 9 may be provided on one side of a front side of the door 7. When a door handle portion is provided on a front side of the door frame 71, the locking unit 9 may be mounted on the door handle portion.

The door 7 may include the door frame 71 and the transparent member 70 that is mounted on the opening formed in the door frame 71. The door frame 71 may include a first door frame 710 and a second door frame 711 that is mounted on a bottom surface of the first door frame 710. The first door frame 710 and the second door frame 711 may be coupled to each other by a hook method or fastened to each other by a fastening member. The coupling method between the first door frame 710 and the second door frame 711 is not limited thereto.

An accommodating portion 715 in which a rotational protrusion 91 of the locking unit 9 is inserted may be provided in the door frame 71, so that the locking unit 9 to be described later may be rotatably mounted in the door frame 71. The accommodating portion 715 may be formed by a first insertion portion 714*a* that protrudes on a bottom surface of the first door frame 710 and a second insertion portion 714*b* that protrudes on a top surface of the second door frame 711.

The locking unit 9 may include a body 90 and the rotational protrusion 91 that is provided in the body 90 of the locking unit 9. The rotational protrusion 91 may protrude in a direction of the rotational axis of the locking unit 9. The rotational protrusion 91 may be inserted in the accommodating portion 715 formed in the door frame 71. The rotational protrusion 91 may be provided on one side of a protrusion 900 that extends from one surface of the body 90 so that the rotational protrusion 91 is spaced apart from the one surface of the body 90 by a predetermined distance. By way of example, the protrusion 900 may vertically protrude and extend from the one surface of the body 90. The rotational protrusion 91 may extend to be parallel with the one surface of the body 90 from an end of the protrusion 900.

On the front side of the locking unit 9, a grip portion 93 that may be manipulated by a user may be provided. The grip portion 93 may be provided to extend forward from the body 90. By a user manipulating the grip portion 93, the locking state between the door 7 and the auxiliary washing unit 8 may be released by the locking unit 9. The grip portion 93 may be provided integrally with the body 90 of the locking unit 9.

On the one surface of the body 90, an elastic member fixing portion 92 in which an elastic member 95 is mounted may be provided. For example, when the elastic member 95 mounted in the locking unit 9 is a cylindrical spring, the elastic member fixing portion 92 may be a protrusion that protrudes from the one surface of the body 90. The cylindrical spring may be inserted into the elastic member fixing portion 92 to be securely fixed.

The elastic member 95 may be provided between the locking unit 9 and the door frame 71 to provide an elastic force for allowing a distance between the locking unit 9 and the door frame 71 to be increased.

The locking unit 9 may be rotatably mounted in the door frame 71. In the second door frame 711, an insertion hole 713 through which a part of the locking unit 9 passes may be formed. The rotational protrusion 91 of the locking unit 9 may pass through the insertion hole 713 and be inserted in the accommodating portion 715 formed in the door frame 71. The rotational protrusion 91 may be provided to perform linear and rotational motions inside the accommodating portion 715. A structure in which the rotational protrusion 91 may perform linear and rotational motions will be described later.

The rotational protrusion 91 of the locking unit 9 passes through the insertion hole 713 of the second door frame 711 and may be seated in the second insertion portion 714*b*, so that the locking unit 9 can be coupled to the door frame 71. When the rotational protrusion 91 is seated in the second insertion portion 714*b*, the elastic member 95 is fixed to the elastic member fixing portion 92, and the first door frame 710 is coupled to an upper portion of the second door frame 711 so that the first insertion portion 714*a* provided in the first door frame 710 corresponds to the second insertion portion 714*b*. Accordingly, the locking unit 9 may be rotatably coupled to the door frame 71.

Figure 8:
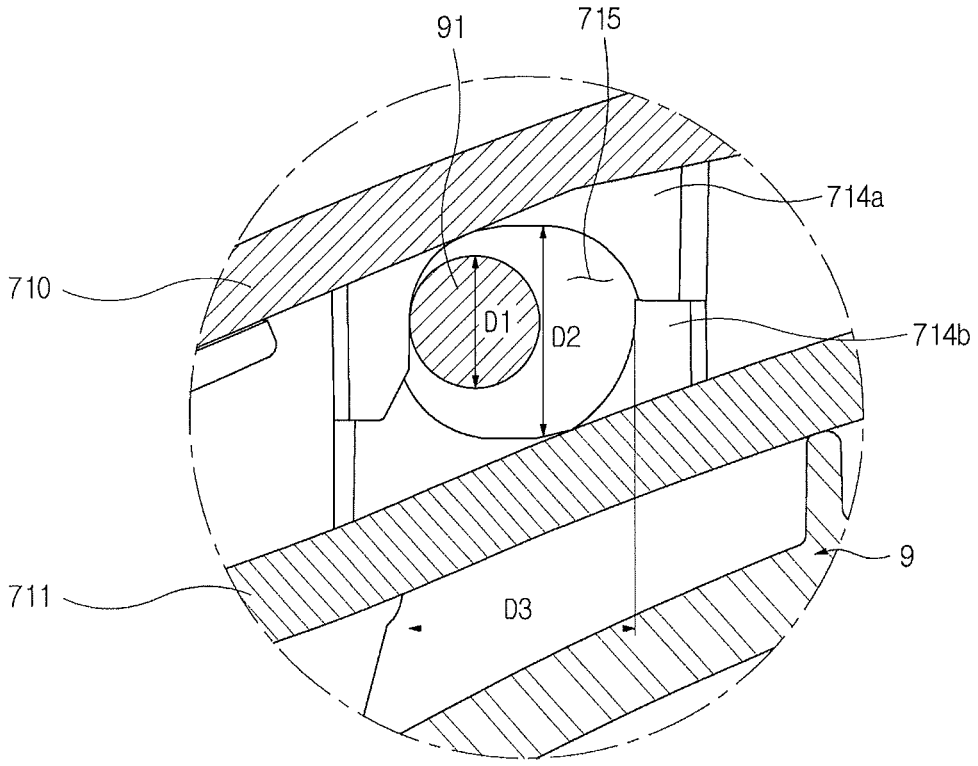
FIGS. 8 and 9 are side cross-sectional views showing a rotation portion of a locking unit in accordance with an embodiment of the disclosure.
Figure 9:
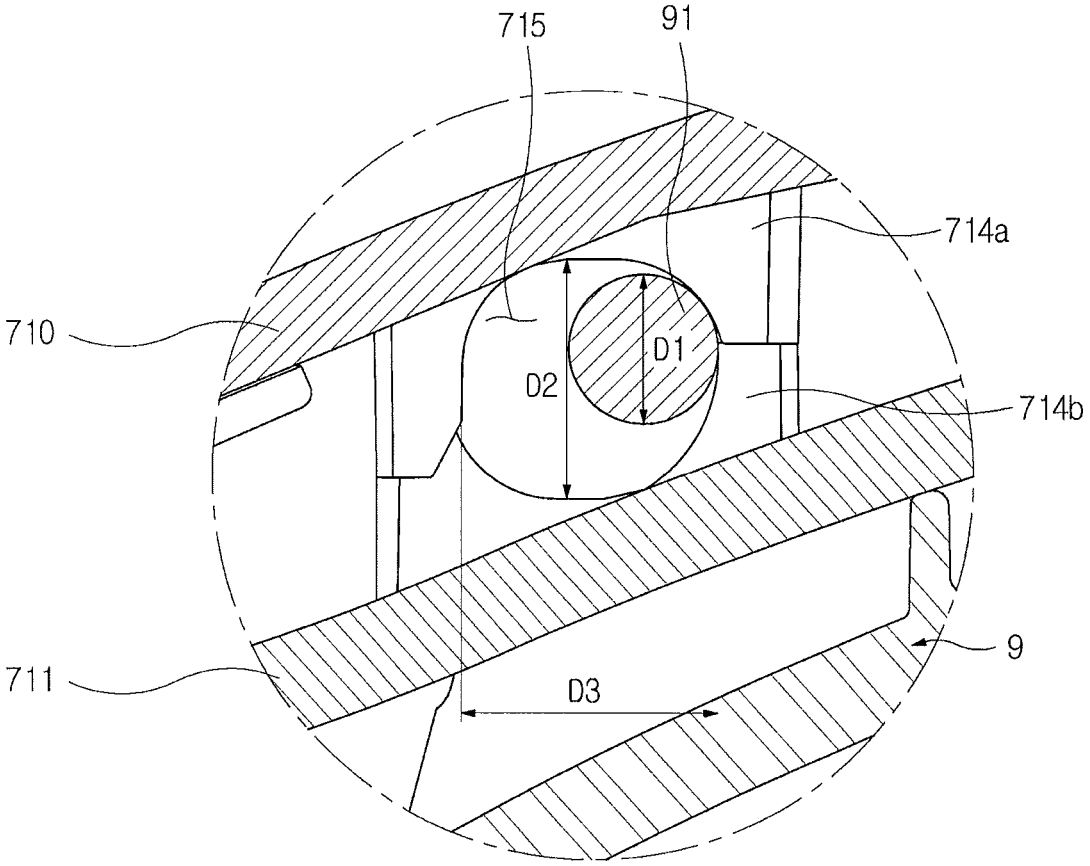

FIGS. 8 and 9 are side cross-sectional views showing a rotation portion of a locking unit in accordance with an embodiment of the disclosure.

Referring to FIGS. 8 and 9, the first and second insertion portions 714*a* and 714*b* that form the accommodating portion 715 in which the rotational protrusion 91 in accordance with an embodiment of the disclosure is inserted may be provided to form an oval side cross section that is roughly formed long (elongated) from the front side to the rear side. That is, inner surfaces of the first and second insertion portions 714*a* and 714*b* that form the accommodating portion 715 may be formed in an ellipse that is formed long (elongated) in forward and rearward directions. In this instance, a direction in which the locking unit 9 is mounted with respect to the door 7 may be referred to as a front side, and a direction opposite to the front side may be referred to as a rear side.

A diameter D1 of the cross section of the rotational protrusion 91 may be the same as or a slightly smaller than a vertical diameter D2 of the inner surfaces of the first and second insertion portions 714*a* and 714*b* that form the accommodating portion 715. A diameter D3, in the forward and rearward directions, of the inner surfaces of the first and second insertion portions 714*a* and 714*b* that form the accommodating portion 715 may be larger than the diameter D1 of the cross section of the rotational protrusion 91 and/or the vertical diameter D2 of the inner surfaces of the first and second insertion portions 714*a* and 714*b*. Accordingly, the rotational protrusion 91 may be rotated inside the accommodating portion 715 in a clockwise or counterclockwise direction, and perform linear motion in the forward and rearward directions F and R (see FIG. 10).

By an external force, the rotational protrusion 91 may be rotated inside the accommodating portion 715 in the clockwise or counterclockwise direction, or perform linear motion in the forward and rearward directions. The rotational protrusion 91 may be provided to perform rotational or linear motion inside the accommodating portion 715, and therefore the locking unit 9 may be rotated about the rotational protrusion 91 or moved in the forward and rearward directions. In this instance, the movement of the locking unit 9 in the forward and rearward directions is possible within a range of a length in which the rotational protrusion 91 can perform linear motion inside the accommodating portion 715, that is, a range of a length obtained by subtracting the diameter D1 of the rotational protrusion 91 from the length D3 of the accommodating portion 715 in the forward and rearward directions.

Hereinafter, operations in which the door 7 and the auxiliary washing unit 8 are locked to each other and unlocked from each other by the locking unit 9 will be described.

Figure 10:
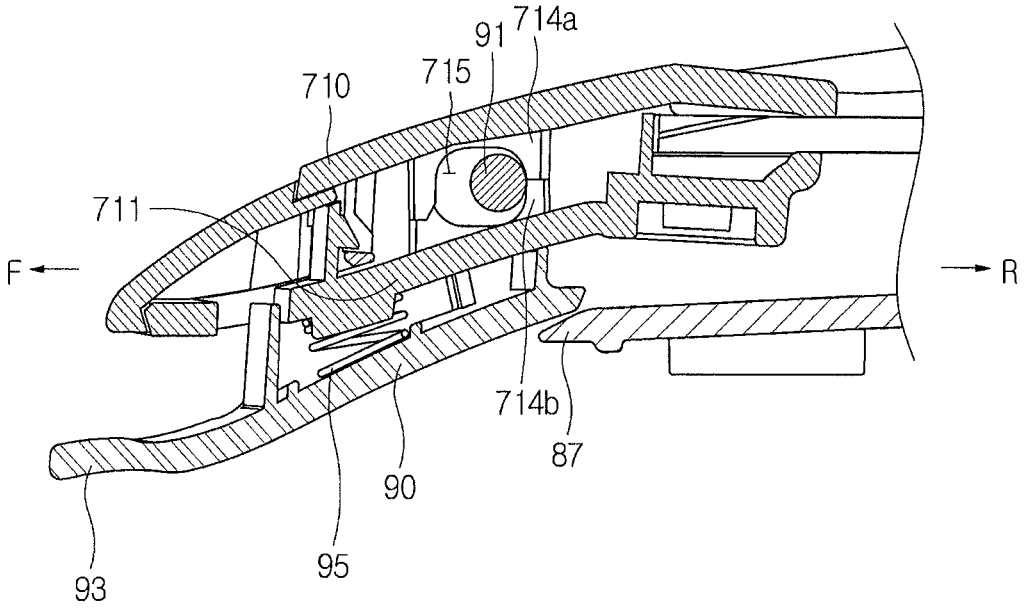
FIGS. 10 to 12 are views showing operations of a locking unit of a door assembly in accordance with an embodiment of the disclosure.
Figure 11:
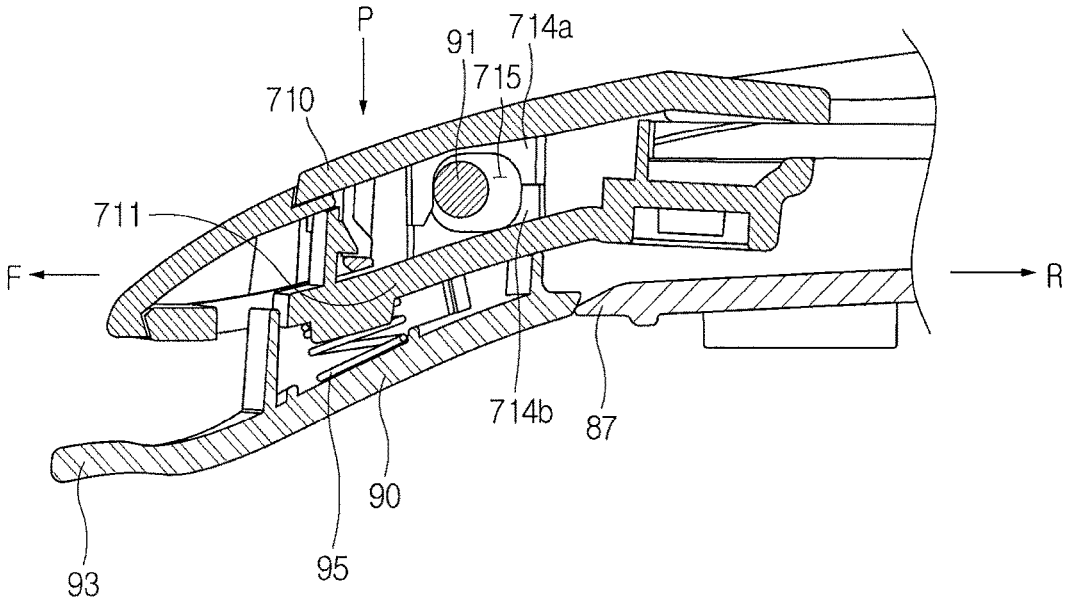
Figure 12:
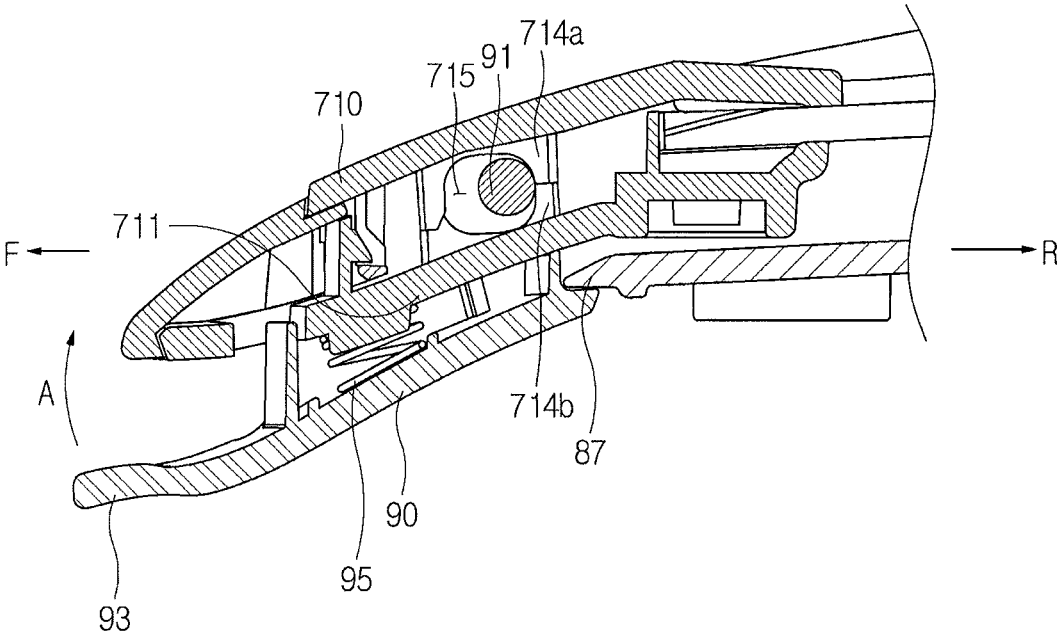

FIGS. 10 to 12 are views showing operations of a locking unit of a door assembly in accordance with an embodiment of the disclosure.

Referring to FIGS. 10 to 12, the door assembly 6 in accordance with an embodiment of the disclosure may be locked by the locking unit 9 so that the door 7 and the auxiliary washing unit 8 are integrally operated, or the locking state of the door assembly 6 by the locking unit 9 is released so that the door 7 and the auxiliary washing unit are operated separately from each other.

As shown in FIG. 10, in a state in which the locking state between the door 7 and the auxiliary washing unit 8 is released, the door 7 may be rotated toward the auxiliary washing unit 8. When the door 7 is rotated about the rotational axis 71*a* to be positioned close to the auxiliary washing unit 8, a part of the body 90 of the locking unit 9 may be positioned above the interference portion 87 of the auxiliary washing unit 8. When an external force P is applied to the top surface of the door 7 (e.g., in a downward vertical direction) in a state in which the part of the body 90 of the locking unit 9 is positioned above the interference portion 87 of the auxiliary washing unit 8, the body 90 of the locking unit 9 may be pressed by the interference portion 87 and linearly moved in the forward direction F. In this instance, the rotational protrusion 91 may be moved to a front side of the accommodating portion 715.

As shown in FIG. 11, the body 90 may slidably pass through a side surface portion of the interference portion 87 while being linearly moved in the forward direction F. In this instance, the rotational protrusion 91 may be linearly moved to the front side inside the accommodating portion 715, and therefore the body 90 may be linearly moved in the forward direction F.

The body 90 passes through the interference portion 87, and then is moved in the rearward direction R by an elastic force of the elastic member 95 to be returned to a position before the external force is applied, as shown in FIG. 12. In this instance, the rotational protrusion 91 may be linearly moved to the rear side inside the accommodating portion 715, so that the body 90 may be moved in the rearward direction R. Accordingly, the body 90 may be in a state of being interfered with by the interference portion 87. The body 90 of the locking unit 9 is interfered with by the interference portion 87 provided in the auxiliary washing unit 8, and therefore the door 7 and auxiliary washing unit 8 to which the locking unit 9 is coupled may be locked to each other so as to be integrally operated. The door 7 and the auxiliary washing unit 8 are locked to each other by the locking unit 9, and therefore the door 7 and the auxiliary washing unit 8 may be integrally opened and closed.

In a state in which the door 7 and the auxiliary washing unit 8 are locked to each other by the locking unit 9 so as to be integrally operated, when an external force is applied to the grip portion 93 so as to allow the grip portion 93 to be rotated in one direction A in order that an end of the grip portion 93 approaches toward the door frame 71, the locking unit 9 may be moved in the rearward direction R of the accommodating portion 715 while being rotated about the rotational protrusion 91. That is, when the external force is applied so that the end of the grip portion 93 is positioned closed to the door frame 71, and the rotational protrusion 91 may be rotated in one direction A. The body 90 may be linearly moved to the front side F as shown in FIG. 11. The body 90 is moved to the front side F, and therefore a locking release state in which the body 90 of the locking unit 9 is not interfered by the interference portion 87 is obtained. In the locking release state in which the body 90 is not interfered by the interference portion 87, a user may open and close the door 7 by rotating the door 7 separately from the auxiliary washing unit 8.

The user may release the locking state by the locking unit 9, and then open the door 7 to perform auxiliary washing in the auxiliary washing space 80. After performing auxiliary washing, the user may open the auxiliary washing unit 8 by rotating the auxiliary washing unit 8, and then put laundry into the main washing space 11*a*. When the auxiliary washing is not required, the user may simultaneously open the door 7 and the auxiliary washing unit 8 in the locking state by the locking unit 9.

In this manner, when being locked to each other by the locking unit 9, the door 7 and the auxiliary washing unit 8 may be opened and closed integrally with each other, and when being unlocked from each other, the door 7 and the auxiliary washing unit 8 may be opened and closed separately from each other. The body 90 of the locking unit 9 may be linearly moved in the forward and rearward directions, and therefore the operations in which the body 90 is interfered with by the interference portion 87 or the interference is released may be smoothly performed, thereby improving the usability.

As is apparent from the above description, according to the washing machine in accordance with one or more embodiments of the disclosure, it is possible to easily perform fastening between the door and the auxiliary washing unit by the locking unit for fastening the door and the auxiliary washing unit. In addition, it is possible to reduce noise that occurs at the time of the locking between the door and the auxiliary washing unit, and prevent occurrence of deformation in the fastening portion of the locking unit.

Although embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A washing machine, comprising:

a main body having an opening disposed at an upper portion of the main body;

a door rotatably disposed on the main body and configured to open and close the opening; and an auxiliary washing unit disposed between the opening and the door when the opening is closed by the door, wherein the door comprises:

a hinge unit disposed at a rear side of the door, a locking unit disposed at a front side of the door, the locking unit being configured to lock the door to the auxiliary washing unit and release the door from the auxiliary washing unit, and including a rotation protrusion protruding from a body of the locking unit, and an accommodating portion configured to support the rotation protrusion to perform linear and rotational motion inside the accommodating portion so that the locking unit is moveable in forward and rearward directions and rotatable during locking and unlocking of the locking unit.

2. The washing machine according to claim 1, wherein the accommodating portion is a space in which a diameter in one direction is greater than a diameter in the other direction.

3. The washing machine according to claim 2, wherein the accommodating portion is formed to have a substantially elliptical shape and is elongated in forward and rearward directions.

4. The washing machine according to claim 1, wherein the rotation protrusion performs linear and rotational motion inside the accommodating portion.

5. The washing machine according to claim 1, wherein, when an external force is applied to the locking unit, the locking unit is moved forward toward a front side of the washing machine.

6. The washing machine according to claim 5, wherein the locking unit includes an elastic member that provides an elastic force to the locking unit, and when the external force applied to the locking unit is removed, the locking unit is moved rearward by the elastic member toward a rear side of the washing machine and returned to a position before the external force was applied.

7. The washing machine according to claim 1, wherein a rotation axis of the door is in parallel with a rotation axis of the locking unit.

8. The washing machine according to claim 7, wherein, the auxiliary washing unit comprises an interference portion that protrudes forward toward a front side of the washing machine and is configured to be selectively interfered with by the locking unit.

9. The washing machine according to claim 1, wherein, when the locking unit locks the door to the auxiliary washing unit, the door and the auxiliary washing unit are rotatable together.

10. The washing machine according to claim 1, wherein the door and the auxiliary washing unit are rotatable about a same rotational axis.

* * * * *